United States Patent [19]

Jullien

[11] Patent Number: 4,825,764

[45] Date of Patent: May 2, 1989

[54] CONNECTING DEVICE BETWEEN A FIRING FUSE OF A PYROTECHNIC PRODUCT AND AN IGNITER

[75] Inventor: Marie-Jacques Jullien, Boulogne, France

[73] Assignee: Ruggieri, Paris, France

[21] Appl. No.: 18,269

[22] Filed: Feb. 24, 1987

[30] Foreign Application Priority Data

Feb. 24, 1986 [FR] France ..... 86 02514

[51] Int. Cl.[4] ..... F42C 11/00; F42C 19/12

[52] U.S. Cl. ..... 102/202.14; 102/275.12

[58] Field of Search ..... 102/202.5, 202.7–202.14, 102/200, 275.12, 275.2–275.7; 439/350, 314, 311

[56] References Cited

U.S. PATENT DOCUMENTS

| | | | |
|---|---|---|---|
| 954,689 | 4/1910 | Oliver | 102/202.13 |
| 1,029,261 | 6/1912 | Bernardi et al. | 102/202.13 |
| 1,378,269 | 5/1921 | Oliver | 102/202.13 |
| 2,428,884 | 10/1947 | Lefren | 102/202.14 |
| 2,842,059 | 7/1958 | Plumley et al. | 102/202.14 |
| 3,212,439 | 10/1965 | Reyne | 102/202.14 |
| 3,356,024 | 12/1967 | Driscoll et al. | 102/202.6 |
| 3,976,347 | 8/1976 | Cooke et al. | 439/350 X |
| 3,982,808 | 9/1976 | Marechal | 439/314 X |
| 4,271,453 | 6/1981 | Yajima et al. | 102/202.9 X |
| 4,468,078 | 8/1984 | Frear et al. | 439/314 |

FOREIGN PATENT DOCUMENTS

| | | | |
|---|---|---|---|
| 990138 | 6/1976 | Canada | 102/202.5 |
| 0015697 | 9/1980 | European Pat. Off. . | |
| 605487 | 11/1934 | Fed. Rep. of Germany . | |
| 737112 | 7/1943 | Fed. Rep. of Germany . | |
| 745360 | 1/1945 | Fed. Rep. of Germany . | |
| 7411706 | 9/1974 | Fed. Rep. of Germany . | |
| 2913231 | 10/1979 | Fed. Rep. of Germany | 102/202.5 |
| 1127597 | 12/1956 | France | 102/202.5 |
| 1350114 | 12/1963 | France | 102/202.5 |
| 2561451 | 9/1985 | France . | |
| 2018403 | 10/1979 | United Kingdom . | |

*Primary Examiner*—David H. Brown

*Attorney, Agent, or Firm*—Sughrue, Mion, Zinn, Macpeak, and Seas

[57] ABSTRACT

The connecting device between a firing fuse (2) of a pyrotechnic product and an electric igniter (13) comprises an end member (5) forming a socket fixed to one end of the fuse (2) and a sleeve (12) surrounding the igniter (13) and constituting a plug engaged in the socket (5).

3 Claims, 1 Drawing Sheet

CONNECTING DEVICE BETWEEN A FIRING FUSE OF A PYROTECHNIC PRODUCT AND AN IGNITER

BACKGROUND OF THE INVENTION

The present invention relates to pyrotechnic products for firework elements and more particularly to the firing of pyrotechnic products.

A firework pyrotechnic product usually comprises a tubular case of cardboard or the like which contains an amount of firing powder connected by a delay to the firework composition.

The firing powder is connected to a fuse the ignition of which is achieved by means of a lighter.

Electric ignition means are also used, in which case the end of the fuse remote from the amount of firing powder is placed in contact with an igniter or match consituted by a conductive filament coated with an inflammable composition and connected by two electric conductors to a source of energy such a dry battery.

The connection between the fuse and the igniter is usually protected by a sleeve of plastics material or cardboard surrounding the igniter in which it is engaged.

Such an arrangement has a number of drawbacks.

The positioning of the end of the fuse with respect to the igniter is inaccurate and hardly reliable.

Consequently, there are many ignition failures.

The connection between the fuse and the igniter is devoid of any protection from the weather.

The maintenance of the connection between the fuse and the igniter requires the use of immobilizing means such as paper surrounding the assembly and maintained in position by a string, which increases the cost of placing fireworks in position.

SUMMARY OF THE INVENTION

An object of the invention is to overcome the aforementioned drawbacks of conventional connecting means by providing a connection device between an igniter and a firing fuse of a pyrotechnic product, which is simple in construction and yet is rapidly placed in position and has an improved operational safety.

The invention therefore provides a connecting device between a firing fuse of a pyrotechnic product and an electric igniter, said device comprising an end member forming a socket fixed to one end of the fuse and a sleeve surrounding the igniter and constituting a plug engaged in said socket.

A better understanding of the invention will be had from the following description which is given solely by way of example with reference to the accompanying drawings, in which :

DETAILED DESCRIPTION OF PREFERRED EMBODIMENTS

Figure 1:
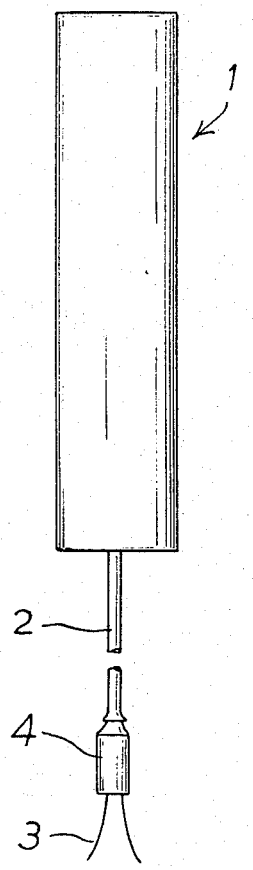
FIG. 1 is a diagrammatic view of a pyrotechnic product provided with a connecting device according to the invention.

The pyrotechnic product illustrated in FIG. 1 is a firework rocket 1 provided with a firing fuse 2 connected to an igniter which is connected to an electric source of energy such as dry battery by an electric lead 3 having two conductors through a connecting device 4 according to the invention.

Figure 2:
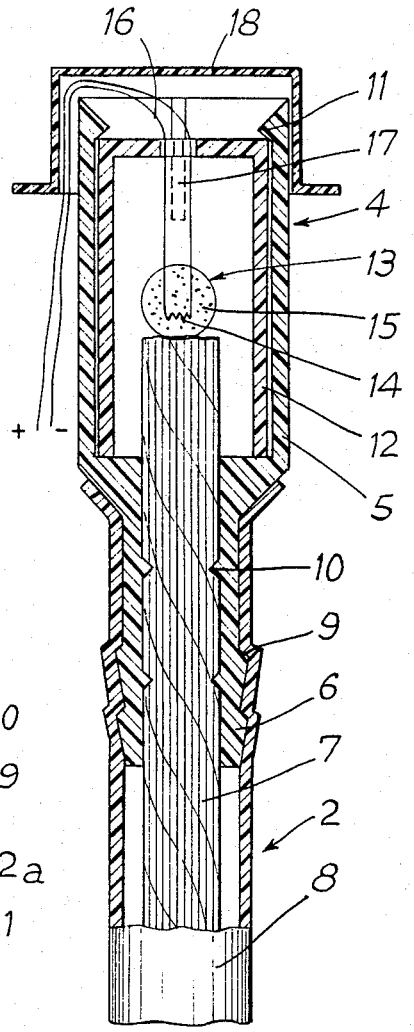
FIG. 2 is a view partly in elevation and partly in section of the connecting device according to the invention.

The device for connecting the fuse to the igniter shown in FIG. 2 mainly comprises an end member 5 which has a socket and which is provided with a tubular connector 6 which is in one piece therewith and engaged between the fuse 7 proper and the sheath 8 of plastics material of this fuse. The connector 6 advantageously has outer projections 9 adapted to maintain it axially relative to the sheath 8 and inner projections 10 for axially maintaining the fuse 7.

At its free end, the end member 5 has an inner flange 11 adapted to maintain in position a sleeve 12 forming a plug and containing an igniter 13 whose resistant filament 14, surrounded by a inflammable material 15, is connected to two electric conductors 16 intended to be connected to a source of energy such as a dry battery (not shown).

The end member 5 and the sleeve 12 forming a plug are advantageously made from plastics material.

The end member 5 further comprises axial slots 17 for facilitating the insertion of the sleeve 12, forming a plug, into the cavity of the socket by spreading apart the lateral wall portions defined by the slots, the inner flange 11 of the socket closing onto the rear end of the sleeve 12 so as to immobilize the sleeve in translation. The slots 17 also permit the withdrawal of the sleeve 12 and consequently the igniter 13 by a spreading apart of the lips formed by the flange 11.

Thus it can be seen that such an arrangement ensures a rapid and reliable connection of the igniter 13 with the end of the fuse 7 which extends into the socket 5.

The connecting device just described is completed by a cap 18 of plastics which caps the socket and pinches the conductors 16. This cap provides an additional safety as concerns the connection between the socket 5 and the sleeve 12 and improves the sealing of the assembly from the effects of weather.

Figure 3:
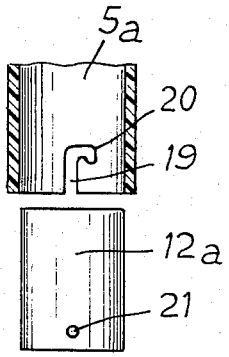
FIG. 3 is an exploded partial view of a modification of the connecting device according to the invention.

FIG. 3 is a partial view of a modification of the connecting device according to the invention in which the socket of an end member 5a is provided with inner axial grooves 19 extended by throats 20 which are roughly perpendicular to the grooves 19 and with which cooperate diametrically opposed pins 21 provided on the outer surface of the sleeve **12*a* constituting a plug. When the sleeve 12*a* is inserted in the socket, the pins 21 are engaged in the axial grooves and, when they reach the end of these grooves, a rotation of the sleeve 12*a* causes their engagement in the throats 20 and the immobilization of the sleeve 12*a*** with respect to the socket. Such a device is known under the name bayonet coupling.

Figure 4:
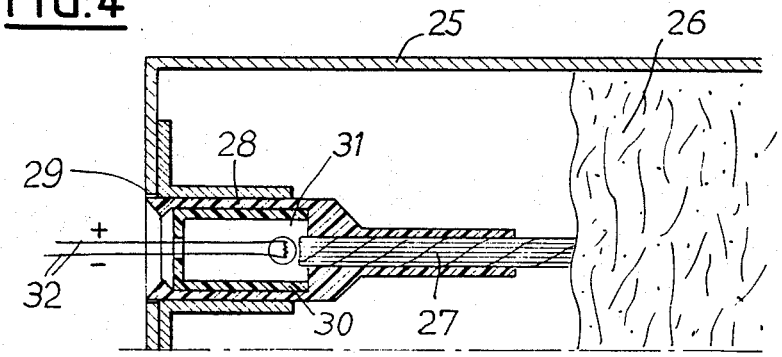
FIG. 4 is a partial sectional view of a connecting device according to the invention incorporated into a pyrotechnic product.

A connecting device according to the invention incorporated in a pyrotechnic product is shown in FIG. 4.

The pyrotechnic product comprises a case 25 containing a mass of firing powder 26 and a fuse 27 provided with an end member 28 having a socket and disposed in an axial aperture 29 in an end wall of the case 25. A sleeve 30, constituting a plug and protecting an igniter 31, is engaged in the socket of end member 28. The igniter 31 is connected to two electric conductors adapted to be connected to a source of electric energy (not shown).

The construction of the end member 28 and the sleeve 30 constituting a plug is identical to that of the corresponding components of the connecting device shown in FIG. 2.

The arrangement shown in FIG. 4 shows how it is possible to integrate the connecting device according to the invention directly, and consequently without the use of an intermediate lead,into a pyrotechnic device.

What is claimed is :

1. A connecting device, for removably connecting an electric igniter to a fuse of a pyrotechnic producing, said device comprising an end member, having a socket, fixed to one end of said fuse, and a removable sleeve, surrounding and containing said igniter and forming a plug, engaged in said socket, wherein said socket is directly mounted in an aperture of a case of a pyrotechnic product.

2. A connecting device for removably connecting an electric igniter to a fuse of a pyrotechnic producing, said device comprising an end member, having a socket, fixed to one end of said fuse, and a removable sleeve, surrounding and containing said igniter and forming a plug, engaged in said socket; wherein said fuse has a sheath, and said socket comprises an integral tubular connector engaged between said fuse and said sheath; wherein said tubular connector has outer projection means, for axially maintaining said socket relative to said sheath, and inner projection means for axially maintaining said fuse relative to said connector; wherein said socket has, at an end thereof remote from said connector, an inner flange means for maintaining in position said sleeve in said socket; wherein said socket has axial slot means permitting the separation of lateral wall portions of said socket when said sleeve is inserted into or withdrawn from said socket; and wherein the remote end of said socket has a central opening through which pass leads connected to said igniter, and further comprising protective cap means mounted on said socket, after engagement of said sleeve in said socket, and for pinching the leads against an external wall of said socket.

3. A connecting device for removably connecting an electric igniter to a fuse of a pyrotechnic producing, said device comprising an end member, having a socket, fixed to one end of said fuse, and a removable sleeve, surrounding and containing said igniter and forming a plug, engaged in said socket; wherein said fuse has a sheath, and said socket comprises an integral tubular connector engaged between said fuse and said sheath; wherein said tubular connector has outer projection means, for axially maintaining said socket relative to said sheath, and inner projection means for axially maintaining said fuse relative to said connector; wherein said socket has, at an end thereof remote from said connector, an inner flange means for maintaining in position said sleeve in said socket; wherein said socket has axial slot means permitting the separation of lateral wall portions of said socket when said sleeve is inserted into or withdrawn from said socket; and wherein said socket is directly mounted in an aperture of a case of a pyrotechnic product.

* * * * *